US011857032B1

(12) United States Patent
Rowland et al.

(10) Patent No.: US 11,857,032 B1
(45) Date of Patent: Jan. 2, 2024

(54) BELT BUCKLE SYSTEM WITH THREADED RETAINERS

(71) Applicant: TEAM NexBelt Operating, Inc., Rancho Cucamonga, CA (US)

(72) Inventors: Edward Rowland, Rancho Cucamonga, CA (US); Tom Hunsucker, Rancho Cucamonga, CA (US)

(73) Assignee: TEAM Nexbelt Operating, Inc., Rancho Cucamonga, CA (US)

( * ) Notice: Subject to any disclaimer, the term of this patent is extended or adjusted under 35 U.S.C. 154(b) by 1275 days.

(21) Appl. No.: 15/999,564

(22) Filed: Aug. 20, 2018

Related U.S. Application Data

(60) Provisional application No. 62/547,835, filed on Aug. 20, 2017.

(51) Int. Cl.
*A44B 11/00* (2006.01)
*A41F 9/00* (2006.01)

(52) U.S. Cl.
CPC ..... *A44B 11/005* (2013.01); *A41F 9/002* (2013.01); *A41D 2200/10* (2013.01)

(58) Field of Classification Search
None
See application file for complete search history.

(56) References Cited

U.S. PATENT DOCUMENTS 4,823,443 A * 4/1989 Waters ..... B61D 45/00 24/68 CD
5,031,956 A * 7/1991 Hudgins ..... B60J 7/104 248/505
5,806,145 A * 9/1998 Chen ..... A44B 11/14 24/191
5,875,523 A * 3/1999 Chen ..... A44B 11/006 24/191
6,137,675 A * 10/2000 Perkins ..... G06F 1/163 361/679.08
6,145,169 A * 11/2000 Terzuola ..... A44B 11/005 24/191
6,295,700 B1 * 10/2001 Plzak ..... A44B 11/12 24/134 R
6,427,291 B1 * 8/2002 Kim ..... A44B 11/14 24/191
6,560,825 B2 * 5/2003 Maciejczyk ..... A44B 11/14 24/191
6,698,070 B2 * 3/2004 Chen ..... A44B 11/006 24/303

(Continued)

FOREIGN PATENT DOCUMENTS

FR 2382206 A1 * 9/1978 ..... A44B 11/20

*Primary Examiner* — Khoa D Huynh
*Assistant Examiner* — Grace Huang
(74) *Attorney, Agent, or Firm* — Foley & Lardner LLP

(57) ABSTRACT

Clothing belt adjustment systems are configured for wearing around a user's body such as around the waist. The belt adjustment system includes a belt and a buckle wherein the belt can be looped and secured to the buckle to secure the belt around a user's waist or other portion of the body. The buckle has a body with a thin side profile that is not overly bulky such that it can comfortably fit over the button region of a wearer's pants. The buckle advantageously includes one or more threaded retainer members, such as threaded screws, that secure one portion of the buckle to another portion of the buckle.

3 Claims, 9 Drawing Sheets

(56) References Cited

U.S. PATENT DOCUMENTS

| | | | | |
|---|---|---|---|---|
| 6,748,630 | B2 * | 6/2004 | Livingston | A44B 11/125 24/712.1 |
| 8,590,114 | B2 * | 11/2013 | Shindo | A44B 11/006 24/178 |
| 8,689,364 | B2 * | 4/2014 | Rowland | A44B 11/12 2/311 |
| 9,145,932 | B2 * | 9/2015 | Xiao | B60P 7/083 |
| 9,149,090 | B1 * | 10/2015 | Taylor | A44B 11/006 |
| 9,210,971 | B2 * | 12/2015 | Catanese | A44B 17/0064 |
| 9,277,775 | B2 * | 3/2016 | Lopez | A41D 27/085 |
| 9,345,288 | B1 * | 5/2016 | Greenberg | A44B 11/24 |
| 9,560,898 | B2 * | 2/2017 | Hortnagl | A44B 11/2592 |
| 9,961,967 | B2 * | 5/2018 | Costenbader | B60P 7/0823 |
| 10,208,778 | B2 * | 2/2019 | Hunsucker | A41F 9/002 |
| 10,321,752 | B2 * | 6/2019 | Zentil | B25G 1/085 |
| 10,433,619 | B2 * | 10/2019 | Wong | A44B 11/12 |
| 10,548,362 | B1 * | 2/2020 | Hunsucker | A41F 9/002 |
| 10,681,963 | B1 * | 6/2020 | Rowland | A41F 9/002 |
| 10,718,406 | B2 * | 7/2020 | Farrell | A62B 35/0025 |
| 10,881,170 | B1 * | 1/2021 | Hunsucker | A44B 11/005 |
| 10,926,114 | B2 * | 2/2021 | Thompson | A62B 18/084 |
| 10,966,489 | B2 * | 4/2021 | Rowland | A41F 9/002 |
| 10,974,638 | B2 * | 4/2021 | Fountain, III | B65D 63/16 |
| 11,019,887 | B1 * | 6/2021 | Huang | A44B 11/06 |
| 11,083,250 | B2 * | 8/2021 | Mowad | A44B 11/005 |
| 2010/0011487 | A1 * | 1/2010 | Kim | A41F 9/002 2/311 |
| 2013/0305493 | A1 * | 11/2013 | Hortnagl | A44B 11/14 24/170 |
| 2019/0053581 | A1 * | 2/2019 | Hestvik | A44B 11/12 |

* cited by examiner

BELT BUCKLE SYSTEM WITH THREADED RETAINERS

This application claims priority to U.S. Provisional Application Serial No. 62/547,835 entitled "Belt Buckle System with Threaded Retainers" filed on Aug. 20, 2017. Priority is claimed to the aforementioned filing date and the provisional application is incorporated herein by reference in its entirety.

BACKGROUND

Conventional belt buckles or belt adjustment systems are limited in their ability to conform to a particular user's waist size. Belt adjustment systems conventionally secure a belt about a user's waist by relying on a series of spaced holes punched through an end of a belt. A hook of a belt buckle can be inserted through a hole to capture the end of the belt to secure the belt in a loop of a particular size. The spacing between each of the holes as well as the overall number of holes can vary for adjustment of belt size, but is generally limited by the minimal material that must remain between the holes.

Conventional belt adjustment systems are limited to setting the size of the belt loop to discrete sizes based upon the spacing of the holes in the belt. If a user desires to set the belt to a loop size that is positioned between the holes in the belt, the user has to manually create an additional hole in the belt, which can be difficult and unattractive if not performed well. Alternately, the user must use the next smaller or next larger belt loop size relative to the desired size, which can be uncomfortable for the user.

Other belt adjustment systems are known that increase the flexibility of adjustment to a variety of waist sizes, but these adjustment systems are not typically fashionable or aesthetically pleasing.

SUMMARY

There is a need for a belt adjustment system that permits a continuum of belt loop sizes or a larger selection of belt loop sizes. Disclosed herein are clothing accessories, particularly belt adjustment systems for wearing around a user's body such as around the waist. The belt adjustment system includes a belt and a buckle wherein the belt can be looped and secured to the buckle to secure the belt around a user's waist or other portion of the body.

In an embodiment, the buckle includes a front face that is movable between an open and closed position to reveal or hide, respectively, a chamber within the buckle. The chamber is sized and shaped to contain one or more items when the front face is closed. In an embodiment, the items include at least one golf ball marker and at least one golf divot repair tool that also serves as a bottle opener. The buckle has a body with a thin side profile that is not overly bulky such that it can comfortably fit over the button region of a wearer's pants. The buckle advantageously includes one or more threaded retainer members, such as threaded screws, that secure one portion of the buckle to another portion of the buckle.

Other features and advantages should be apparent from the following description of various embodiments, which illustrate, by way of example, the principles of the claimed subject matter.

BRIEF DESCRIPTION OF THE DRAWINGS

These and other aspects will now be described in detail with reference to the following drawings.

DETAILED DESCRIPTION

Before the present subject matter is further described, it is to be understood that this subject matter described herein is not limited to particular embodiments described, as such may of course vary. It is also to be understood that the terminology used herein is for the purpose of describing particular embodiments only, and is not intended to be limiting. Unless defined otherwise, all technical terms used herein have the same meaning as commonly understood by one skilled in the art to which this subject matter belongs.

Figure 1:
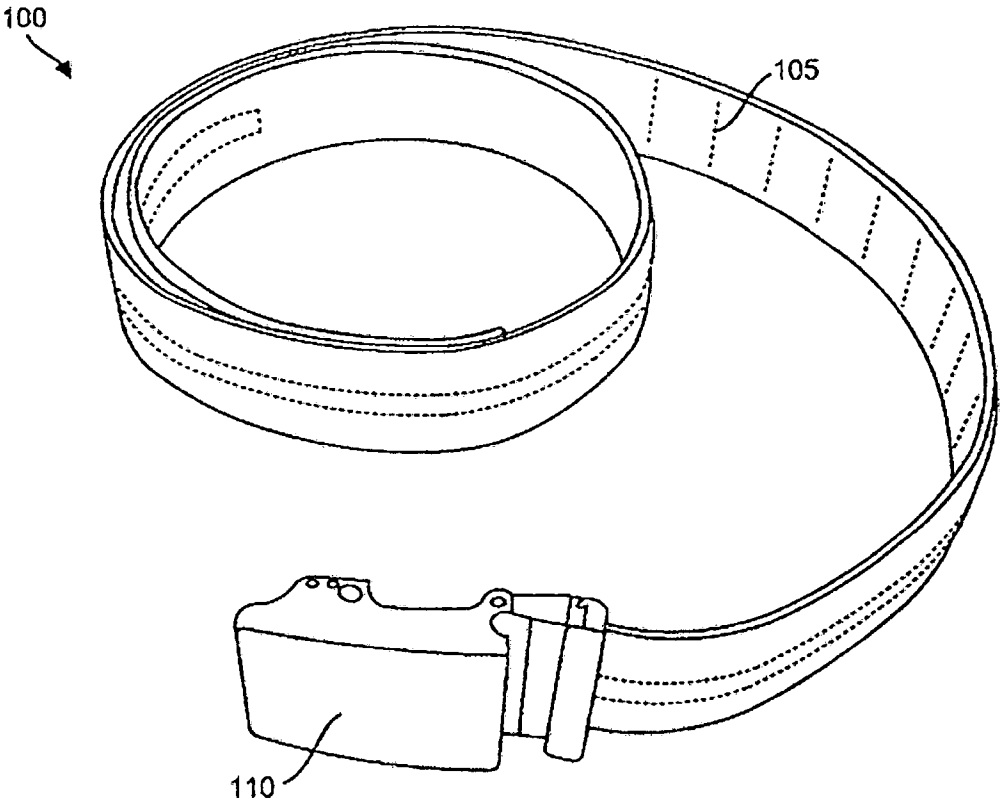
FIG. 1 shows a schematic view of an embodiment of a belt system.

FIG. 1 shows a perspective view of an embodiment of a belt system 100 that may be worn with a pair of pants, shorts, trousers, skirts or other articles of clothing. The system 100 can also be used with other items such as watch straps, purse straps, guitar straps or animal collars or other articles that may include a buckle system that is adjusted for size or where a number of size variations would be desirable. Some figures include exemplary numerical dimensions. It should be appreciated that the dimensions are for example only and are not intended to be limiting. The belt buckle system can be configured with dimensions outside of the ranges and values shown.

The belt system 100 includes an elongated belt 105 and a buckle 110 disposed on a first end of the belt 105. The buckle 110 is removably attached to the belt such as by using a clamp on the buckle 110. The belt buckle 110 is a pinless buckle in that it does not use a pin to secure itself to the belt 105 when the belt is looped around a user's waist. The belt buckle 105 has a front face that faces away from a user or a user's torso when the belt is worn around the user's waist. That is, the belt buckle 105 sits flat against the user's waist or torso such that the buckle will be positioned over the region of the user's pants where a button is typically located on the user's pants.

In an example embodiment, the belt 105 is coupled to a holster that is sized and shaped to hold a firearm, such as a pistol or gun.

Figure 2:
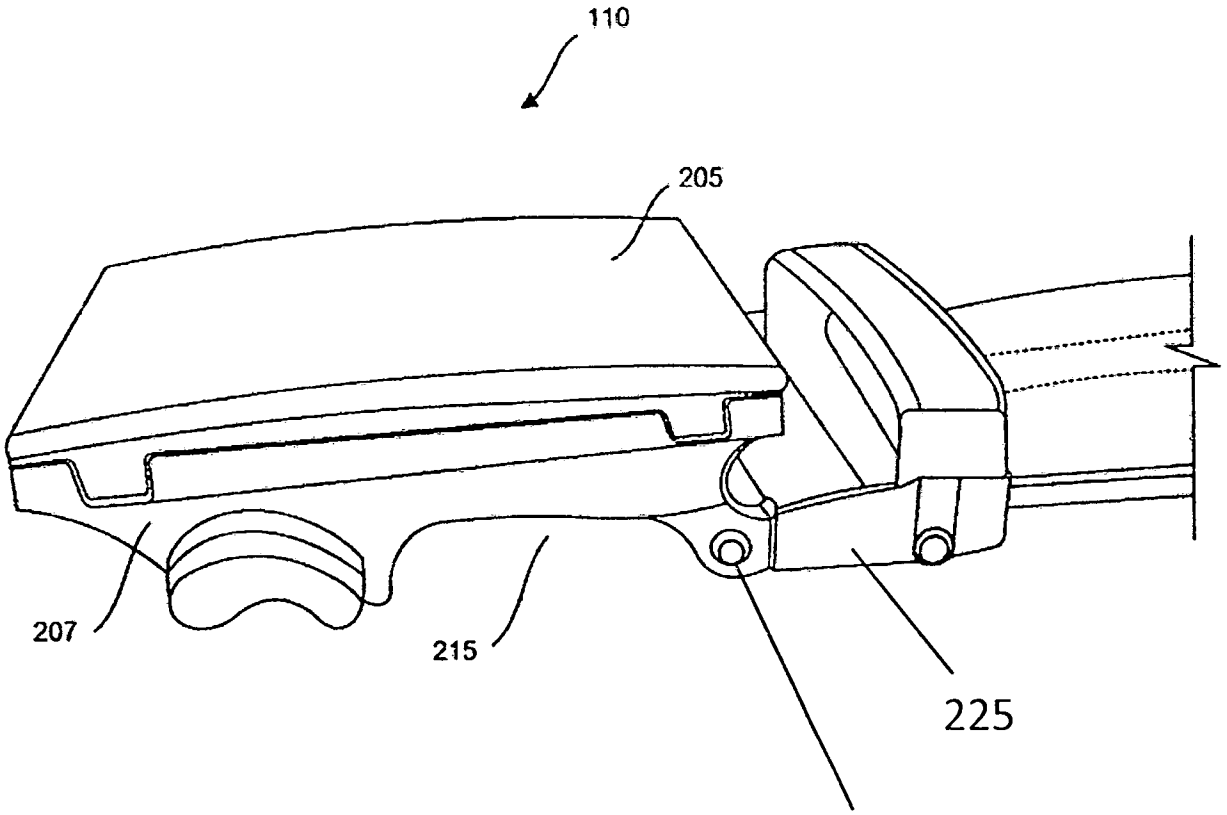
FIG. 2 shows a perspective, side view of a belt buckle of the belt system.
Figure 3:
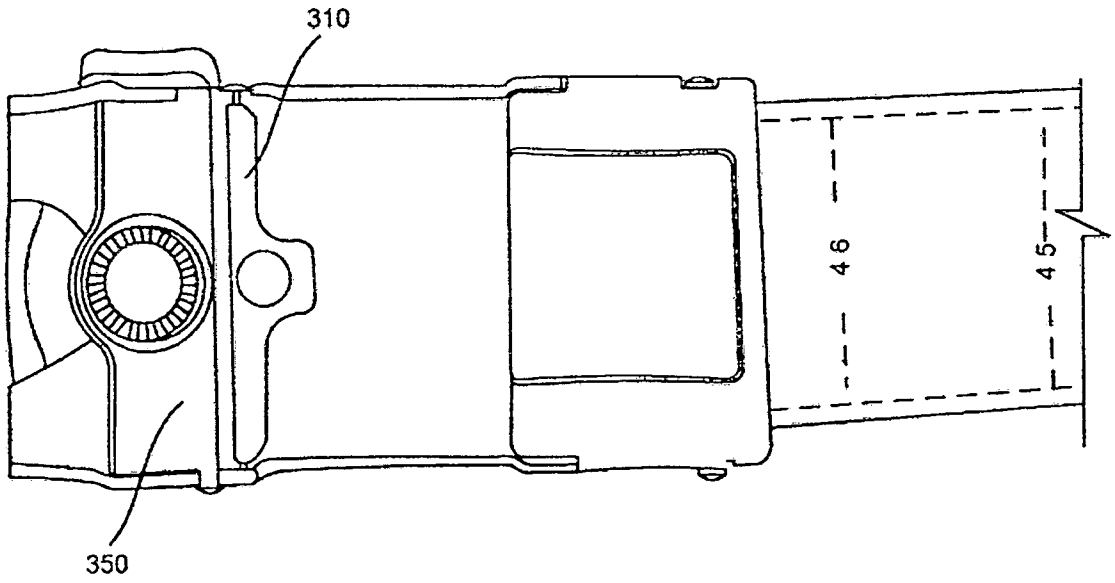
FIG. 3 shows a bottom view of the belt buckle.
Figure 4:
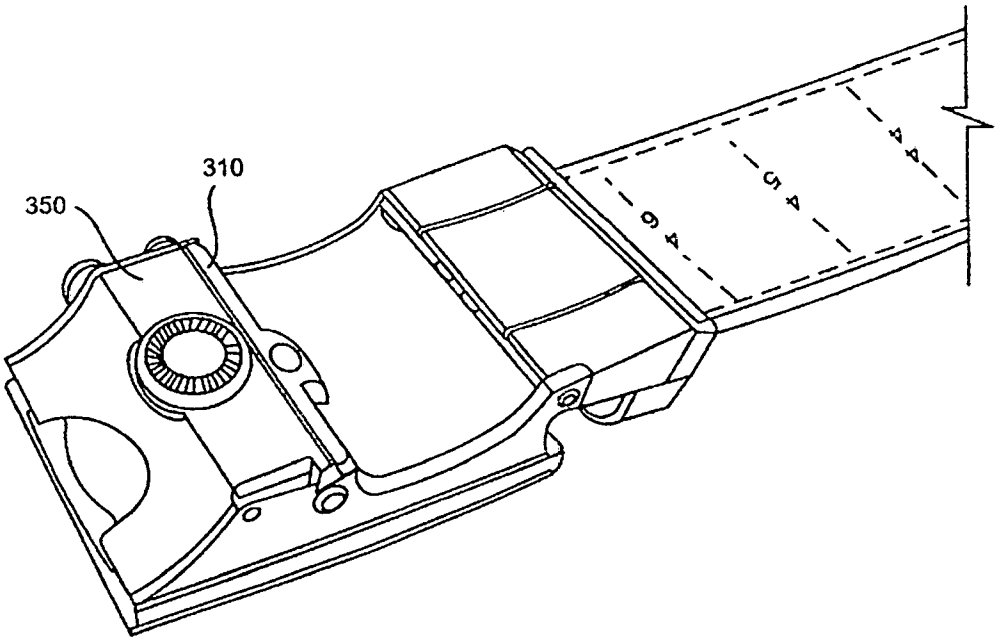
FIG. 4 shows a bottom view of the belt buckle.

FIG. 2 shows a perspective, side view of the belt buckle 110. FIGS. 3 and 4 show bottom views of the belt buckle 110. The belt buckle 110 has a front face that is formed by a door 205 or other movable portion. The door 205 is movable relative to a body 207 of the belt buckle such that the door 205 can be opened (such as in a pivoting manner) relative to the body to expose an internal chamber, as described in more detail below. A belt loop structure 225 is attached to a main body of the buckle 110 such as at one or more attachment locations 230. In an embodiment, the belt loop structure 225 can pivot or rotate about an axis that intersects the attachment location 230. In addition, as described more fully below, at least one threaded member, such as a threaded screw, extends through the belt loop structure 225 and the main body of the buckle 110 to secure the belt loop structure 225 to the main body.

With reference to FIGS. 3 and 4, the buckle 110 has a bridge 350 that forms or at least partially defines an opening through which the opposite end of the belt can be threaded when worn by a user. A movable latch 310 or other pinless member is configured to move towards and engage with a portion of the opposite end region of the belt when the opposite region is positioned through the opening formed by the bridge 350 for securing the belt to the buckle in a desired position. In an embodiment, the latch 310 secures to a tooth or other engagement portion formed within a row of engagement portions on the belt. The latch 310 can be biased toward a latching engagement with the belt such as by using a biasing member, which can be, for example, a magnet, a spring, or other device.

As mentioned above with reference to FIG. 2, at least one threaded member, such as a threaded screw, extends through the belt loop structure 225 and the main body of the buckle 110 to secure the belt loop structure 225 to the main body. A threaded member such as a threaded screw can also be used to secure other portions of the buckle 110 to one another. For example, a threaded screw can be used to secure the bridge 350 to the main body of the buckle. This is different and more secure than using a non-threaded pin to secure the buckle portions to one another. A non-threaded pin has a tendency to loosen from the buckle such that the buckle can become unstable or fall apart at some point during use.

Figure 9:
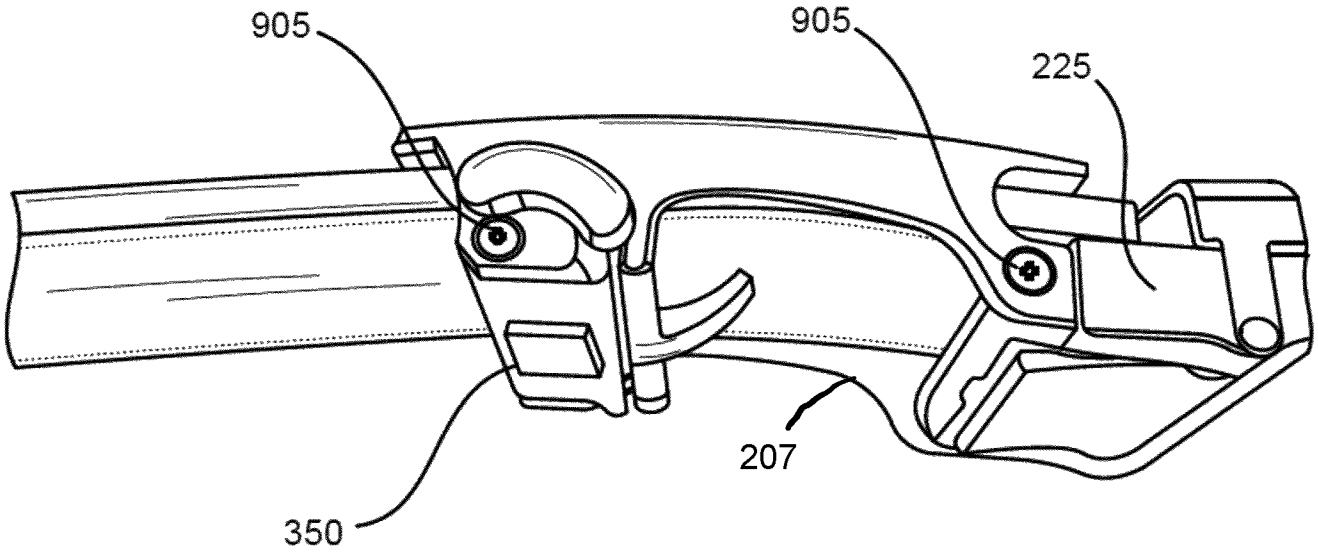
FIG. 9 shows a side view of the another embodiment of a buckle with threaded retainer members

FIG. 9 shows a side view of the belt buckle. One or more threaded members, such as threaded screws 905, secure portions of the belt buckle to one another. For example, threaded screws 905 secure the bridge 350 and/or the belt loop structure 225 to the main body of the belt buckle. In this regard, one or more aligned, threaded openings or passageways can extend through the bridge 350 and the main body. A screw 905 can be threadedly positioned in the aligned passageways to secure the components of the buckle to one another via the screw 905. It should be appreciated that threaded screws can be used to secure other portions of the buckle to one another. In addition, the threaded screw can have various types of heads, such as Allen heads, for attaching to a drive member, such as an Allen wrench.

The threaded screw 905 is an elongated body such as a cylindrical body having a head on a proximal end and threads on an external surface of a distal region of the body or over the entire body. The head portion of the screw may be enlarged in diameter relative to a remainder portion of the screw or may have the same diameter as the remainder portion of the screw. The screw 905 is an externally threaded fastener capable of being inserted into holes in any portion of the buckle for securing a first component of the buckle to any other component or components of the buckle. The screw is capable of mating with a preformed internal thread or forming its own thread within the respective hole, and of being tightened or released by torquing the head. In an example embodiment, the screw has a diameter in the head and/or body portion of 3 mm. In another embodiment, the screw has a diameter of 1-2 mm or 1-3 mm.

It should be appreciated that threaded screws are much more secure than pins or other types of non-threaded structures. The threaded screws can withstand forces that the buckle undergoes during use. The buckle can experience high levels of torque and linear forces, which can cause the buckle to come apart or otherwise malfunction. The threaded screws 905 eliminate or greatly reduce the likelihood that the belt buckle will come apart as a result of such forces.

In a method of manufacture, one or more of the components of the buckle are provided. The components are assembled in a manner that forms the shape of the buckle. One or more of the components can be drilled or tapped with appropriate sized holes, openings, or passageways that are sized and shaped to receive a corresponding screw. One or more of the holes, openings, or passageways can be threaded. The appropriate sized screw can then be inserted into a corresponding opening and threadedly retained in the opening to secure one or more components of the buckle to other components of the buckle.

With reference now to the side view of FIG. 2, the body 207 of the buckle 110 is shaped such that a cavity or cut out 215 is formed on the side of the body 207. The cut out 215 is such that a region of the body 207 is thinner relative to an adjacent region, with the region being thinner along a dimension or direction normal to a wearer's body when the belt is worn around the wearer's waist. That is, the direction is a direction along the line of sight of a person that is facing the wearer and looking toward the front side of the wearer. In this manner, the body of the buckle is so dimensioned so that the wearer's pants button does not contribute to or cause the belt buckle to protrude any further outward from the wearer's pants if the wearer's pants did not have a button in the region of the buckle when the buckle is worn. The cut out is so dimensioned relative to a wearer's pant button so that the pant button fits within the cut out.

The cutout 215 is sized and shaped to form a gap in the body of the buckle in which the wearer's pants button can be positioned when the belt is worn. In this manner, the buckle can be positioned atop the button without the button contributing to the overall size of the buckle or pushing the buckle outward away from the user's body. The button therefore does not interfere with the belt buckle and does not result in the buckle being pushed outward from the user's body when the belt is worn around the waist. FIG. 2 shows one side view of the belt buckle. It should be appreciated that the opposite side view of the belt buckle also has a cutout 215 similar to the cutout 215 shown in FIG. 2. The cutout 215 is located along the length of the belt buckle with the length being the longitudinal direction of the belt member. The cutout 215 extends along only a portion of the entire length of the belt buckle such that the belt buckle has a thickness that is greater where the cavity or cutout 215 is not located relative to whether cavity or cutout 215 is located.

Figure 5:
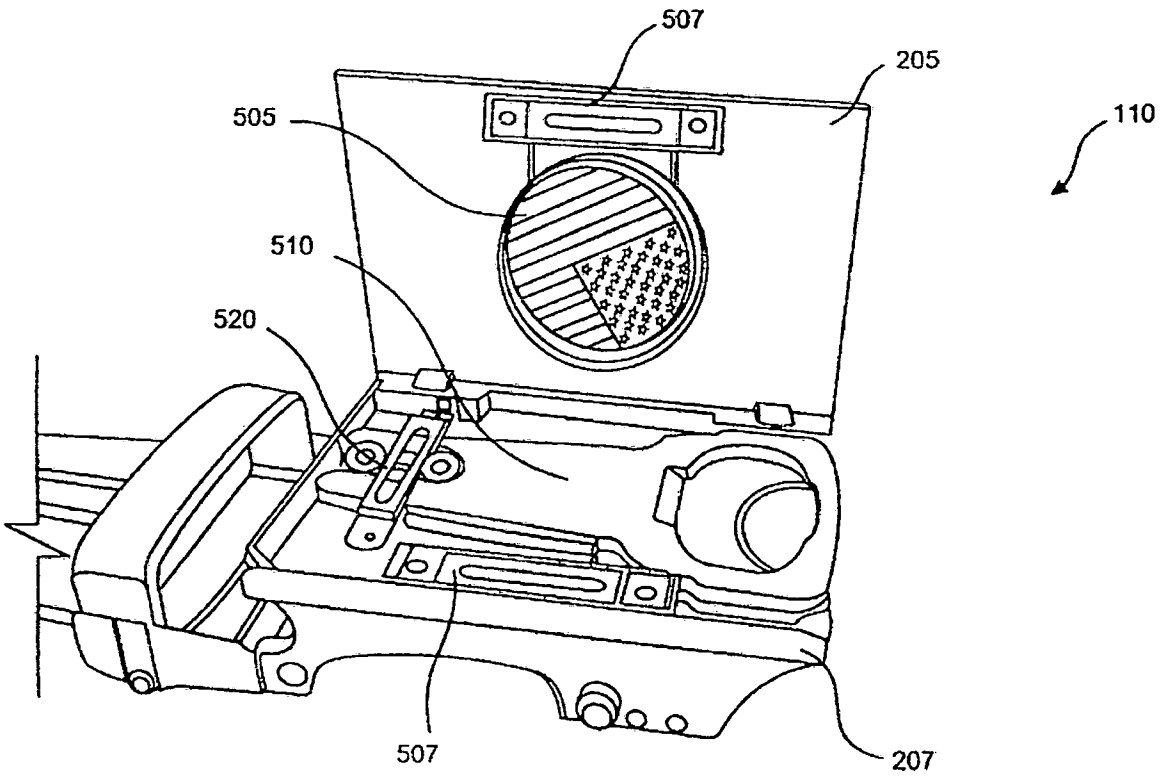
FIG. 5 shows the belt buckle with a door in an open state such that an internal chamber is exposed.

FIG. 5 shows the belt buckle 110 with the door 205 in an open state such that the internal chamber is exposed. The internal chamber is exposed and accessible when the door 205 is open as shown in FIG. 5. When the door 205 is closed (as in FIGS. 1 and 2 for example), the door 205 is positioned relative to the belt buckle body such that the internal chamber is covered and hidden by the door 205. In this manner, the internal chamber is collectively formed by the body of the belt buckle and the door 205 when the door is closed.

The door 205 may move relative to the body of the belt buckle in a variety of manners including in a pivoting or rotating manner. In this regard, the one or more hinges attach the door 205 to the belt buckle body. Other types of movement are possible such as a sliding movement between the door 205 and the body.

Figure 6:
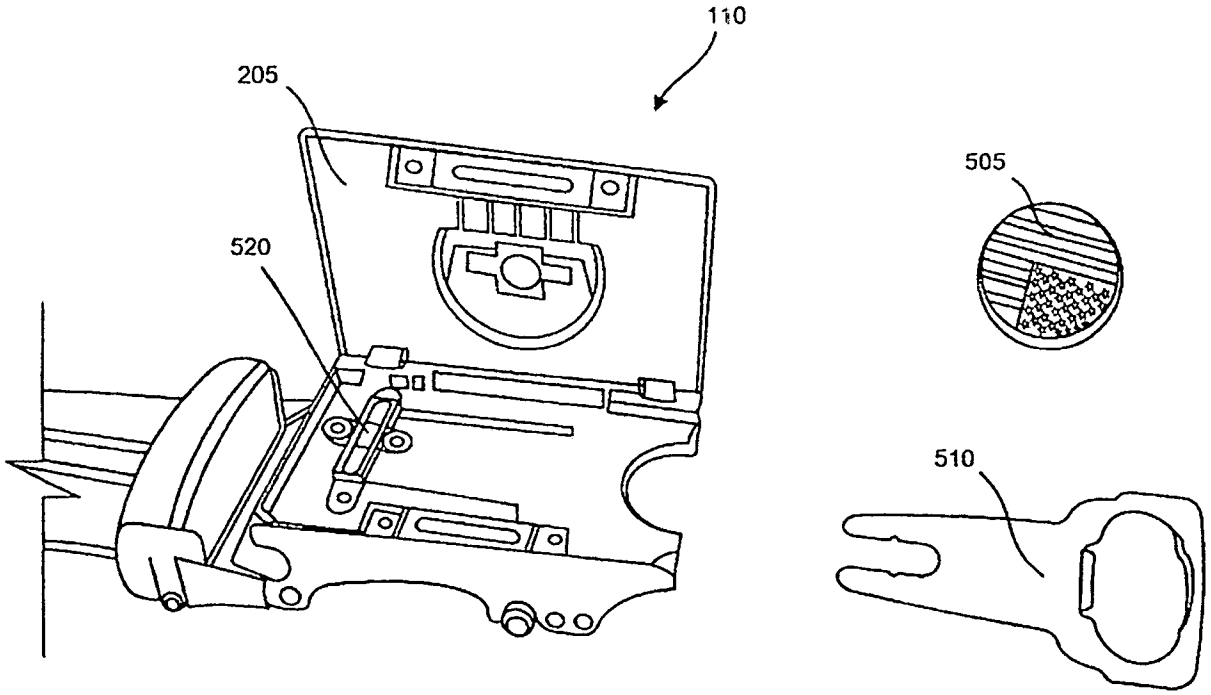
FIG. 6 shows the belt buckle with a door in an open state such that an internal chamber is exposed and components removed from the internal chamber.

As shown in FIG. 5, the internal chamber is sized and shaped to contain one or more items. The items are covered or hidden when the door 205 is closed. In the illustrated embodiment, the items include a ball marker 505, which is disc-like member. The ball marker is positioned within a complementary-shaped indentation on the inner side of the door 205 and can be secured thereto such as by a magnet for example. The items also include a golf divot repair tool 510 that sits on the body 207 in the internal cavity. The divot repair tool 510 is secured within the cavity by a crossing member 520 that fits over the divot repair tool and secures it therein such as in a press fit manner. Other retaining elements can also be used such as one or more magnets to secure the divot repair tool 510 or other items in the chamber. FIG. 6 shows the buckle 110 with the ball marker 505 and divot repair tool 510 removed from the internal chamber.

With reference to FIG. 5, the door 205 can be secure in the closed position such as by using one or more magnetic engagements 507 between the body 207 of the buckle and the door 205. In this regard, a magnet may secure in the door 205 and/or the body 207 so that they contact one another and secure the door in the closed position when the door is closed. The magnet(s) may be positioned and secured beneath a securing element, such as a bridge structure 350. Other ways of securing the door in the closed position can be used.

Figure 7:
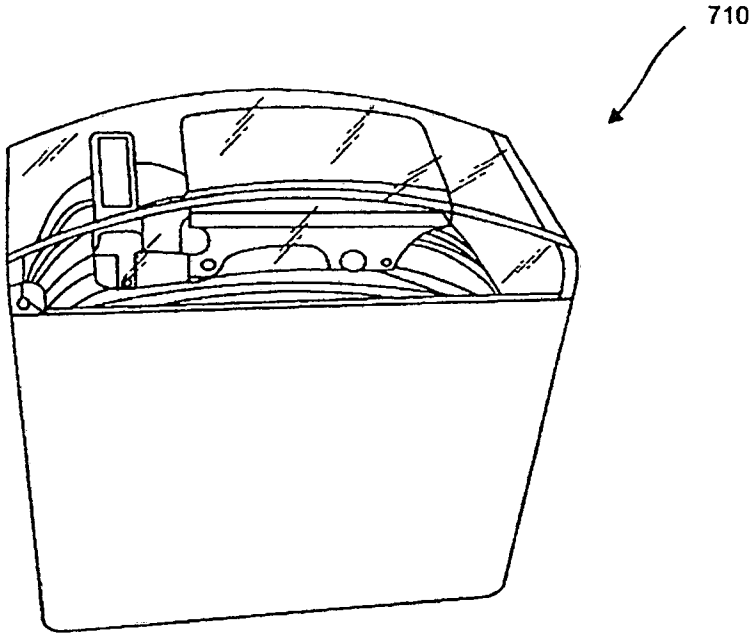
FIG. 7 shows an example of a belt container in which the belt can be stored.
Figure 8:
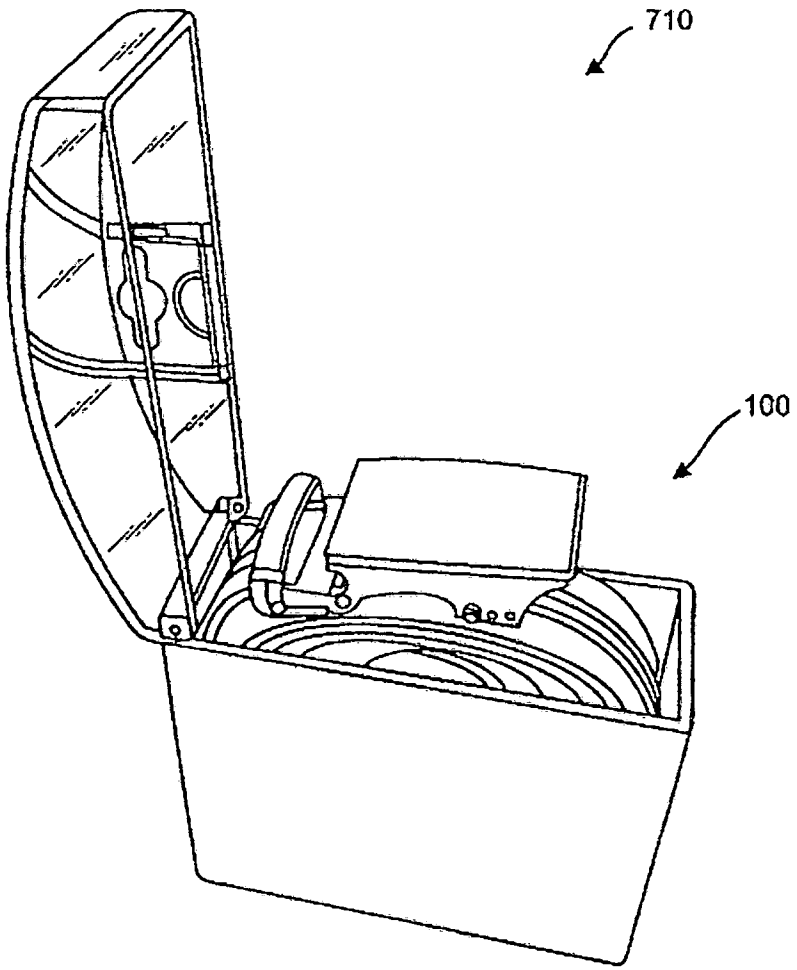
FIG. 8 shows the belt container in an open state.

In an embodiment, the belt 100 can be stored in a belt container 710, as shown in FIGS. 7 and 8. The belt container 710 is sized and shaped to define an interior cavity that can contain the belt 100 in a rolled state. The interior cavity of the container 710 is sized so that the belt 100 is snugly stored within the container 710 such that the belt will not rattle or move when the container is closed. In this regard, the container 710 has a door that can be opened (as shown in FIG. 8) and closed (as shown in FIG. 7) to provide access to the belt.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results. Only a few examples and implementations are disclosed. Variations, modifications and enhancements to the described examples and implementations and other implementations may be made based on what is disclosed.

Although embodiments of various methods and devices are described herein in detail with reference to certain versions, it should be appreciated that other versions, embodiments, methods of use, and combinations thereof are also possible. Therefore, the spirit and scope of the appended claims should not be limited to the description of the embodiments contained herein.

The invention claimed is:

1. A method of manufacturing a belt buckle for clothing, comprising:

assembling at least two components of the belt buckle, wherein the at least two components include a main body and a bridge, wherein the bridge and the main body collectively define an opening through which a belt can be inserted longitudinally through the opening;

aligning a threaded passageway of the main body and a passageway of the bridge, wherein the threaded passageway and the passageway of the bridge are configured to be coaxially aligned;

inserting a threaded screw into the threaded passageway of the main body and the passageway of the bridge; and rotating the screw so that the screw threads into the threaded passageway of the main body and the passageway of the bridge to secure the bridge to the main body wherein the belt further comprises a first end and a second end, and wherein the main body is configured to connect to the first end, and the second end of the belt is configured to be inserted through the opening defined by the main body and the bridge.

2. The method of claim 1, wherein the threaded screw has a 1 mm diameter.

3. The method of claim 1, wherein rotating the screw pivotally secures the bridge to the main body.

* * * * *